United States Patent [19]

Villette

[11] 4,226,574

[45] Oct. 7, 1980

[54] MAGNETICALLY DRIVEN PUMP

[76] Inventor: Guy J. Villette, Bilieu, 38850 Charavines, France

[21] Appl. No.: 900,481

[22] Filed: Apr. 27, 1978

[30] Foreign Application Priority Data

May 6, 1977 [FR] France ..... 77 14476

[51] Int. Cl.[3] ..... F04B 17/00

[52] U.S. Cl. ..... 417/420; 310/104

[58] Field of Search ..... 417/420; 310/104; 192/83 PM; 64/28 M

[56] References Cited

U.S. PATENT DOCUMENTS

| | | | |
|---|---|---|---|
| 3,195,467 | 7/1965 | Collet | 417/420 |
| 3,205,827 | 9/1965 | Zimmermann | 417/420 |
| 3,238,878 | 3/1966 | Martin | 310/104 X |
| 3,520,642 | 7/1970 | Fulton | 417/420 |
| 3,802,804 | 4/1974 | Zimmermann | 417/420 X |
| 3,932,068 | 1/1976 | Zimmermann | 417/420 |

FOREIGN PATENT DOCUMENTS

| | | | |
|---|---|---|---|
| 2620502 | 11/1976 | Fed. Rep. of Germany | 417/420 |

*Primary Examiner*—Carlton R. Croyle
*Assistant Examiner*—Edward Look
*Attorney, Agent, or Firm*—Stevens, Davis, Miller & Mosher

[57] ABSTRACT

An electromagnetically driven pump in which a stationary metallic shaft carries the pump impeller. The shaft is rigidly secured to a metallic separating wall having an outer flange secured to the coupling housing. The impeller is driven by a magnetic coupling and the separating wall extends between the elements of said coupling to prevent fluid communication therebetween.

3 Claims, 2 Drawing Figures

MAGNETICALLY DRIVEN PUMP

The invention relates to a magnetic motor-driven centrifugal impeller pump suitable for the chemical industry in handling corrosive liquids.

Heretofore centrifugal pumps have a separating wall between the impeller housing and the coupling housing and to avoid the rotating shaft passing through the wall to drive the impeller and the consequent packing for the shaft it has already been proposed to rotatably mount the impeller on a stationary shaft. The impeller is driven magnetically by external permanent magnets arranged at the exterior side of said separating wall and rotated by a motor. Internal permanent magnets are secured to the impeller and cooperate with the external magnets to provide a drive coupling through a magnetic field. The known separating wall is of platic material and for rigidly supporting the shaft the latter passes through the wall and is supported by ball bearings carried by the rotor. The device is free from rotating seals but the static seal between the shaft and the separating wall is rapidly worn out by the shaft vibrations.

One of the objects of the invention is to provide a magnetic driven pump having a stationary shaft rigidly supported at one end and independently of the motor shaft so as to prevent vibrations and the leakage of fluid along the shaft.

Another object of this invention is to provide favorable cooling conditions of the shaft carrying the impeller.

Another object of this invention is to provide a pump which may operate empty of fluid without excessive heating.

In accordance with the present invention, the heat of the shaft is transferred through a metallic end wall directly to the metallic coupling housing and this metallic communication also provides rigid support of the shaft.

Another object of the invention is to provide a self priming pump.

Figure 1:
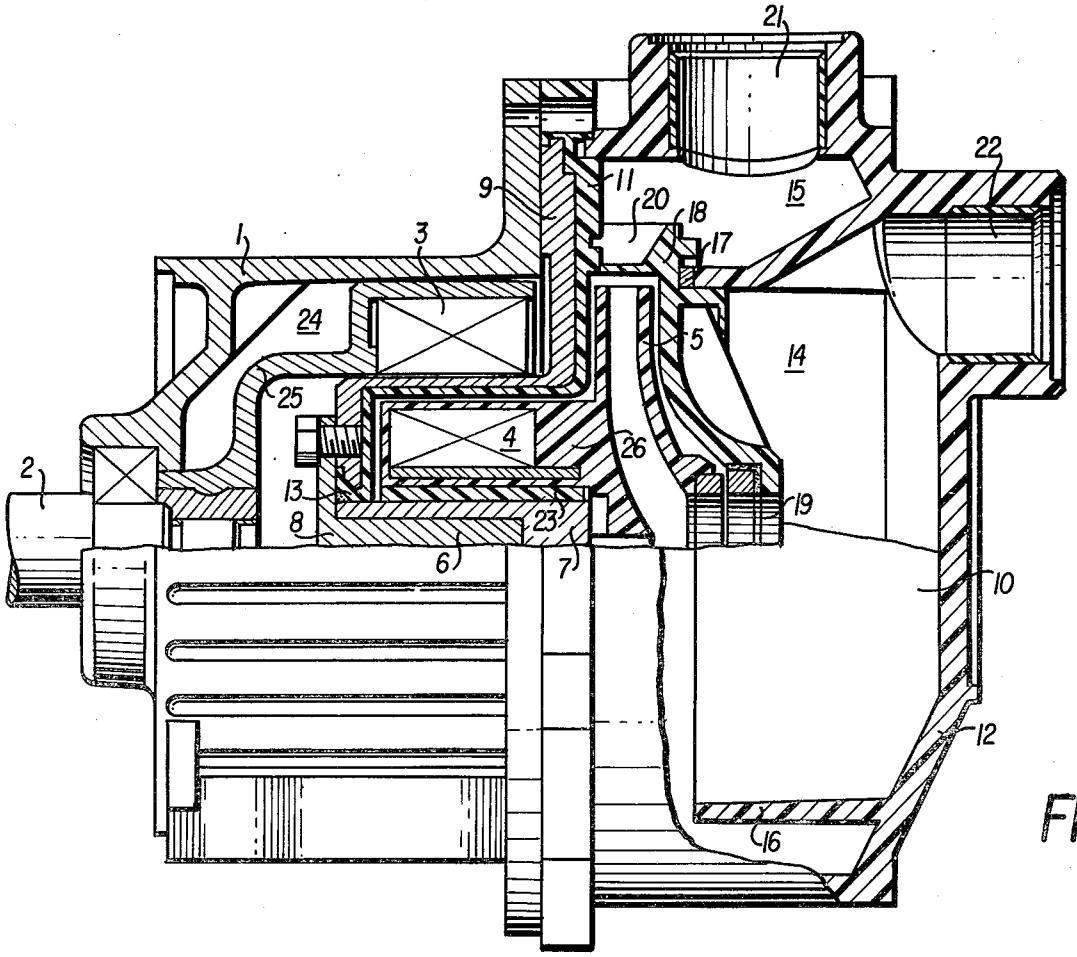
Figure 2:
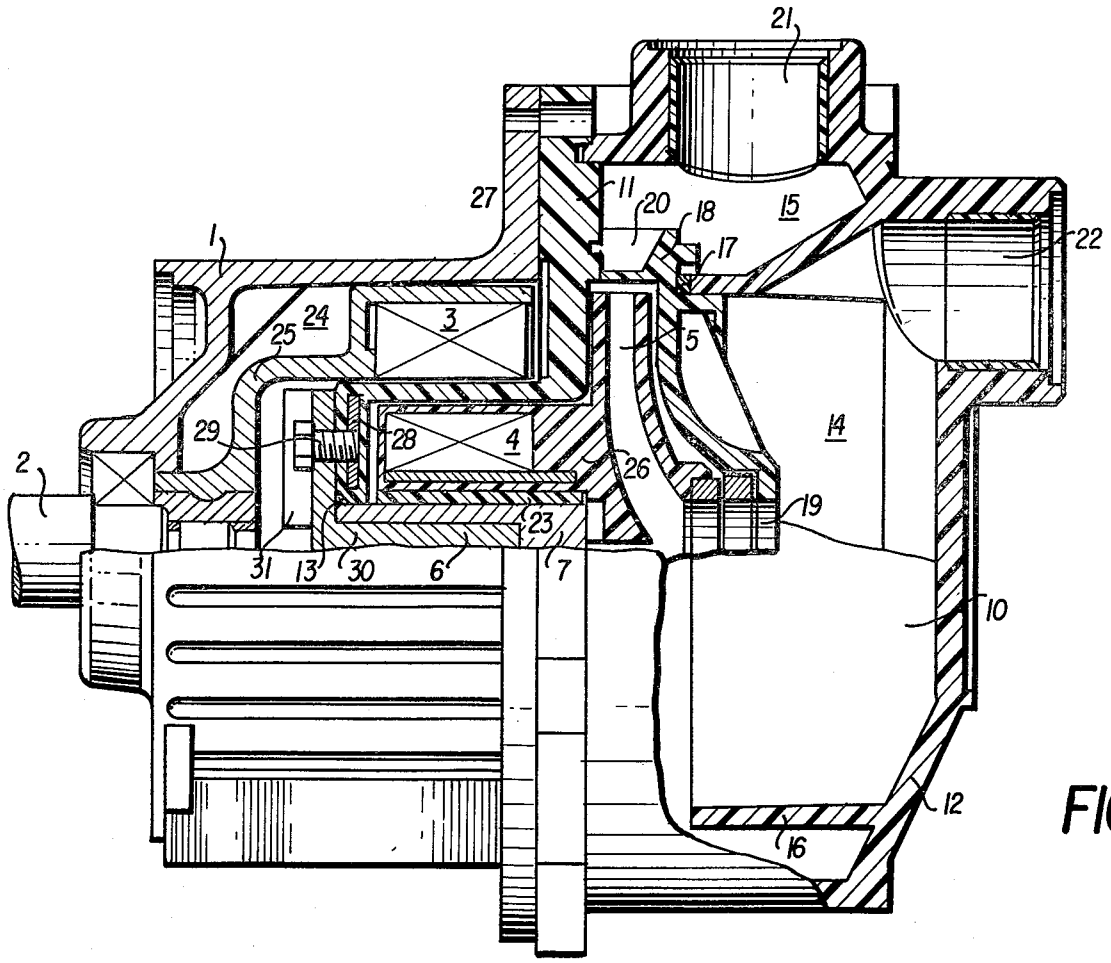

Other and further objects of this invention will become apparent from the following description of the annexed drawing in which FIGS. 1 and 2 are half cross sectional views of two preferred embodiments of the pump.

An electric motor is partially shown having an end flange 1 enclosing a coupling housing 24 and a shaft 2 extending into the coupling housing 24. A cup shaped rotor 25 has permanent magnets 3 fitted on its inner circumference and is carried by the drive shaft 2. Permanent magnets 4 are fitted in closely spaced opposition to the magnets 3 on the outer circumference of a hub 26 of a pump impeller 5. The inner surface of hollow hub 26 is coated with plastic material and rotatably mounted on a bearing sleeve 7, for instance of ceramic material supported by a stationary shaft in alignment with the motor shaft 2.

It is clear that the rotation of motor shaft 2 is transmitted by the magnets 3, 4 to the impeller 5. The stationary shaft 6 has an end flange 8 rigidly secured by bolts or by welding to the bottom of a cup shaped separating wall 9, which separates the coupling housing 24 from an impeller housing 10. The separating wall 9 is secured at is periphery to the motor end flange 1 and is interposed between flange 1 and thepump volute 12. The cylindrical central portion of the separating wall 9 extends in the air gap between the magnets 3 and 4 and is closed by the bottom portion supporting the stationary shaft 6.

The other end of this shaft 6 is unsupported for easy removal of impeller 5. The shaft 6 and the separating wall 9 are of stainless steel and the surface of wall 9 facing the housing 10 is coated with a plastic material 11 such as polypropylene. An annular seal or O-ring 13 is interposed between the plastic coating 11 and the ceramic sleeve 7 to seal hermetically the impeller housing 10 from the coupling housing 24, the corrosive fluid in housing 10 being not in contact with the metallic parts.

The metallic cup shaped wall 9 secured to the metallic motor flnge 1 rigidly supports the impeller shaft 6 and provides a metallic heat conductive communication to transfer the heat from shaft 6 towards the external housing.

The impeller housing 10 comprises a cylindrical partition wall 16 which delimits two chambers, an inner pump inlet chamber 14 and an outer pump exhaust chambr 15. Wall 16 is carried by the pump volute 12, for instance in plastic material and cooperates in fluid tight relation by means of a packing 17 with the outer periphery of a pump casing 18 surrounding the impeller 5. The pump casing 18 has a central axial inlet 19 in communication with the inlet chamber 14 and peripheral outlets 20 towards exhaust chamber 15. An exhaust pipe 21 is connected to chamber 15 and an inlet pipe 22 to chamber 14. The pump shown in the drawing is a horizontal pump and the inlet pipe 22 is shifted towards the top of the pump for instance at the level of the upper rand of impeller 5 in such a manner that chamber 14 always remains filled with fluid even when the pump stops.

The operation of this pump will be readily understood from the foregoing description. The one end supported by shaft 6 is mechanically secured to the metallic separating wall and is in good thermal contact therewith. The stainless steel cylindrical central portion of the wall extending in the air gap does not notably restrain the rotation of the rotor.

Referring to FIG. 2, like characters of reference indicate corresponding parts in each figure. The stationary shaft 6 has an end flange disc 30 the surface of which facing the bottom of the cup-shaped rotor 25. The outer circumference of disc 30 corresponds substantially to the inner circumference of the cup-shaped rotor 25 to provide a great surface area in thermal contact with the air in the coupling housing 24. The disc 30 is secured such as by bolts 29 to the bottom of a cup-shaped separating wall 27 extending in the air gap of between magnets 3, 4. The outer periphery of separating wall 27 is secured to the motor flange 1 and the wall 27 is of insulating material such as plastic, for instance the commercially known "Ritton", a sulphide of polyphenylene. Bolts 29 are secured to a metallic insert 28 embedded in the bottom part of cup-shaped wall 27 which reinforces wall 27.

It will be noted that the rotation of the magnetic field of magnets 3, 4 does not induce electrical currents, the cylindrical part of wall 27 extending in the air gap being non conductive. The heat is withdrawn from the bearing sleeve by the metallic shaft 6 and transferred through the metallic disc 30 to the air in the coupling housing 24. The surface of disc 30 on the side of housing 24 has preferably has fins 31 to provide a greater heat transfer area. The rotation of rotor 25 in the housing 24 will act as a fan to cool disc 30.

What is claimed is:

1. A magnetic motor-driven centrifugal impeller pump suitable for pumping corrosive fluids, which comprises:

a motor having a metallic housing;

an impeller housing having a cup-shaped end closure wall, a metallic shaft within said impeller housing having one end fixedly secured to the bottom of said end closure wall and another unsupported end;

an impeller having a cylindrical hub rotatably mounted on said shaft within said impeller housing;

first permanent magnet means fitted on the outer circumference of said hub;

a corrosion resistant sleeve carried by said shaft and interposed between said shaft and said hub;

a coupling housing in axial alignment with the impeller housing;

a cup-shaped rotor within said coupling housing and surrounding said hub, said rotor being driven by the motor and having second permanent magnet means fitted around the inner circumference of the cup-shaped rotor closely spaced radially outwardly of said first magnet means for providing a magnetic coupling between the impeller and the cup-shaped rotor, said cup-shaped end closure wall having a cylindrical portion thereof interposed between said first and second permanent magnet means and an end flange portion fixedly secured to said coupling housing, said cup-shaped end closure wall being of a nonmagnetic responsive metallic material having a corrosion resistant coating;

a non rotating seal interposed between said sleeve and said coating for shielding said metallic shaft and said metallic wall from fluid communication.

2. A magnetic motor driven centrifugal impeller pump according to claim 1, wherein said end closure wall is of stainless steel and said shaft has a ceramic sleeve carried thereby interposed between said shaft and said hub.

3. A magnet motor-driven centrifugal impeller pump suitable for pumping corrosive fluids, which comprises:

a motor having a metallic housing;

an impeller housing having a cup-shaped end closure wall;

a metallic shaft within said impeller housing having one end fixedly secured to the bottom of said end closure wall and another unsupported end;

an impeller having a cylindrical hub rotatably mounted on said shaft within said impeller housing;

a corrosion resistant sleeve carried by said shaft and interposed between said shaft and said hub;

first permanent magnet means fitted on the outer circumference of said hub;

a coupling housing in axial alignment with the impeller housing;

a cup-shaped rotor within said coupling housing and surrounding said hub, said rotor being driven by the motor and having second permanent magnet means fitted around the inner circumference of the cup-shaped rotor closely spaced radially outwardly of said first magnet means to provide a magnetic coupling between the impeller and the cup-shaped rotor, said cup-shaped end closure wall having a cylindrical portion thereof interposed between said first and second permanent magnet means and an end flange portion fixedly secured to said coupling housing, said cup-shaped end closure wall being of rigid plastic material and having a metallic insert embedded in the bottom thereof, said metallic shaft having a metallic end flang disc with one side thereof in contact with and fixedly secured to the bottom of said end closure wall by screws secured to said metallic insert, said end flange disc being disposed in said coupling housing and having its other side spaced adjacent the bottom and in the interior of said cup-shaped rotor, and its outer circumference closely spaced adjacent the inner circumference of said cup-shaped rotor.

* * * * *